US008640337B2

(12) United States Patent
Muroya et al.

(10) Patent No.: US 8,640,337 B2
(45) Date of Patent: Feb. 4, 2014

(54) PIPE EXPANSION METHOD

(75) Inventors: Itaru Muroya, Hyogo (JP); Yoichi Iwamoto, Hyogo (JP); Hisanori Watanabe, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1125 days.

(21) Appl. No.: 12/307,043

(22) PCT Filed: Jul. 6, 2007

(86) PCT No.: PCT/JP2007/063569

§ 371 (c)(1),
(2), (4) Date: Dec. 30, 2008

(87) PCT Pub. No.: WO2008/010427

PCT Pub. Date: Jan. 24, 2008

(65) Prior Publication Data

US 2009/0199402 A1 Aug. 13, 2009

(30) Foreign Application Priority Data

Jul. 21, 2006 (JP) ..... 2006-199325

(51) Int. Cl.
*B21D 39/10* (2006.01)

(52) U.S. Cl.
USPC ..... 29/890.044; 29/890.038; 29/890.04; 29/890.043

(58) Field of Classification Search
USPC ..... 29/890.044, 890.038, 890.04, 890.043, 29/505, 507, 512, 522.1
See application file for complete search history.

(56) References Cited

U.S. PATENT DOCUMENTS

| | | | |
|---|---|---|---|
| 3,693,387 | A | 9/1972 | Blackburn |
| 3,979,810 | A | 9/1976 | Krips et al. |
| 4,066,861 | A | 1/1978 | Broodman |

(Continued)

FOREIGN PATENT DOCUMENTS

| | | | |
|---|---|---|---|
| CN | 1502965 | A | 6/2004 |
| CN | 2789707 | Y | 6/2006 |

(Continued)

OTHER PUBLICATIONS

Chinese Office Action dated Nov. 27, 2009, issued in corresponding Chinese Patent Application No. 200780023679.

(Continued)

*Primary Examiner* — David Bryant
*Assistant Examiner* — Christopher Besler
(74) *Attorney, Agent, or Firm* — Westerman, Hattori, Daniels & Adrian, LLP

(57) ABSTRACT

A pipe expansion method capable of reducing an inspection range (area) of a heat-transfer pipe secured to a pipe plate and capable of shortening the time required for inspection is provided. In a pipe expansion method for securing a heat-transfer pipe inserted in a pipe hole of a pipe plate by expanding the pipe, after tightly fitting an outer circumferential surface of the heat-transfer pipe to an inner circumferential surface of the pipe hole from a primary-side end face to a secondary-side end face of the pipe plate, surface pressure between the heat-transfer pipe and the pipe plate is further increased in a predetermined range from the secondary-side end face, or close to the secondary-side end face, towards the primary-side end face.

3 Claims, 5 Drawing Sheets

(56) References Cited

U.S. PATENT DOCUMENTS

| | | | | |
|---|---|---|---|---|
| 4,134,286 | A * | 1/1979 | Martin | 72/122 |
| 6,536,252 | B1 | 3/2003 | Waring | |
| 2005/0051314 | A1 | 3/2005 | Heier | |

FOREIGN PATENT DOCUMENTS

| | | | |
|---|---|---|---|
| GB | 1 489 719 | A | 10/1977 |
| JP | 60-172797 | A | 9/1985 |
| JP | 61-159644 | A | 7/1986 |
| JP | 62-104634 | A | 5/1987 |
| JP | 3-31023 | U | 3/1991 |
| JP | 3-180274 | A | 8/1991 |
| JP | 08-332534 | A | 12/1996 |
| JP | 10-26490 | A | 1/1998 |
| JP | 10-160374 | A | 6/1998 |
| JP | 11-28539 | A | 2/1999 |
| JP | 2001-269732 | A | 10/2001 |
| JP | 2003-106789 | A | 4/2003 |
| JP | 2004-98140 | A | 4/2004 |
| TW | M301891 | U | 12/2006 |

OTHER PUBLICATIONS

Exhibit 2 is Utility Model Patent Application No. 087216903 entitled "Roll Ball-Type Pipe Expansion Structure of Metal Rocket Frame" granted and published on May 12, 2000.

Exhibit 4 is Exhibit 2 of Patent Opposition No. 091136338P01, which is "Pipe Processing Method" in the first edition issued by FunWen Book Co. Ltd in the first month of 1984.

Exhibit 5 is Exhibit 3 of Patent Opposition No. 091135338P01, which is an association journal "Forging" of Forging Association of Republic of China (CFA) in Dec. 2011.

Exhibit 6 is Exhibit 4 of Patent Opposition No. 091135338P01, which is "Machinery Monthly Magazine" in Oct. 2000.

International Search Report of PCT/JP2007/'063569, mailing date of Oct. 16, 2007.

Exhibit 1 is the patent under cancellation, entitled "Pipe Expansion Method" which was granted and published on Jun. 21, 2010 with Invention Patent Application No. 096126223 referred to as target patent hereafter.

Exhibit 2 is utility model Invention Patent Application No. 087216903 entitled "Roll Ball Pipe Expansion Structure of Metal Rocket Frame" granted and published on May 21, 2000.

Exhibit 3 is Invention Patent Application No. 091136338 entitled "Method for Shaping Seamless Frame Tube" granted and published on Aug. 11, 2003.

Exhibit 4 is Exhibit 2 of Patent Opposition No. 091136338P01, which is "Pipe Processing Method" in the first edition issued by FunWen Book Co. Ltd. in the first month of 1984.

Exhibit 5 is Exhibit 3 of Patent Opposition No. 091136338P01, which is an association journal "Forging" of Forging Association of Republic of China (CFA) in Dec. 2011.

Exhibit 6 is Exhibit 4 of Patent Opposition No. 091136338P01, which is "Machinery Monthly Magazine" in Oct. 2000.

Exhibit 7 is Exhibit 5 of Patent Opposition No. 091136338P01, which is "Application Status and Prospect of Hydraulic Pressure Forming Technique" issued by Ministry of Economic Affairs, Sep. 30, 2002.

Exhibit 8 is Exhibit 6 of Patent opposition No. 091136338P01, which is Patent Publication No. 552371, Sep. 11, 2003.

Exhibit 9 is Exhibit 7 of Patent Opposition No. 091136338P01, which is Patent Publication No. 526102, Apr. 1, 2003.

Canadian Office Action dated Feb. 24, 2012, issued in corresponding Canadian Patent Application No. 2,655,430, (2 pages).

English translation of Taiwanese Patent Cancellation Brief dated Dec. 30, 2010 for Taiwanese Patent Application No. 096126223N01.

Extended European Search Report dated Oct. 31, 2013, issued in European Patent Application No. 07768301.9.

* cited by examiner

PIPE EXPANSION METHOD

TECHNICAL FIELD

The present invention relates to a pipe expansion method for securing a heat-transfer pipe to a pipe plate of a steam generator or heat exchanger by expanding the heat-transfer pipe.

BACKGROUND ART

A known process for securing a heat-transfer pipe to a pipe plate of a steam generator or heat exchanger is disclosed, for example, in Patent Document 1.

Patent Document 1: Japanese Unexamined Patent Application, Publication No. SHO-60-172797.

DISCLOSURE OF INVENTION

However, with the pipe expansion method disclosed in the above-mentioned Patent Document 1, a retaining force for preventing the heat-transfer pipe from coming out towards a secondary side is ensured by surface pressure obtained between the heat-transfer pipe and the pipe plate, from a primary-side end face to a secondary-side end face of the pipe plate. Therefore, when carrying out inspection of that location (for example, stress corrosion cracking inspection by rotating ECT (Eddy Current Test)), there is a problem in that it must be conducted from the primary-side end face to the secondary-side end face of the pipe plate, and the inspection thus requires a lot of time.

The present invention has been conceived in light of the circumstances described above, and an object thereof is to provide a pipe expansion method capable of reducing the inspection range (area) of a heat-transfer pipe secured to a pipe plate and capable of shortening the time required for the inspection.

In order to solve the problems described above, the present invention employs the following solutions.

A first aspect of the present invention is a pipe expansion method for securing a heat-transfer pipe inserted in a pipe hole in a pipe plate by expanding the pipe, wherein after tightly fitting an outer circumferential surface of the heat-transfer pipe to an inner circumferential surface of the pipe hole from a primary-side end face to a secondary-side end face of the pipe plate, surface pressure between the heat-transfer pipe and the pipe plate is further increased in a predetermined distance range from the secondary-side end face, or close to the secondary-side end face, towards the primary-side end face.

According to this aspect, the surface pressure between the outer circumferential surface of the heat-transfer pipe inserted in the pipe hole and the inner circumferential surface of the pipe hole is increased in a predetermined distance range from the secondary-side end face of the pipe plate, or close to the end surface, towards the primary-side end face, and the fitting characteristics are thus improved.

Accordingly, the expanded pipe in a region from close to the secondary-side end face to the circumferential crack has a retaining force for preventing the heat-transfer pipe from coming out towards the secondary side even if a circumferential crack occurs in the heat-transfer pipe held in the pipe plate and the heat-transfer pipe breaks due to the circumferential crack, and inspection (for example, stress corrosion cracking inspection by rotating ECT (Eddy Current Test)) should be carried out only in this region (the region from close to the secondary-side end face to the circumferential crack), so long as the primary-side fluid (for example, nuclear-reactor coolant) passing through the interior of the heat-transfer pipe does not leak (leak out) into the secondary-side fluid (for example, feedwater) even if a crack occurs in the heat-transfer pipe held in the pipe plate. Therefore, it is possible to substantially reduce the time required for this inspection.

A second aspect of the present invention is a pipe expansion method for securing a heat-transfer pipe inserted in a pipe hole in a pipe plate by widening the pipe, wherein after tightly fitting an outer circumferential surface of the heat-transfer pipe to an inner circumferential surface of the pipe hole from a primary-side end face to a secondary-side end face of the pipe plate, refrigerant is supplied to the interior of the heat-transfer pipe, and when the heat-transfer pipe is sufficiently cooled, the refrigerant supply is stopped so that the heat-transfer pipe returns to normal temperature.

According to this aspect, by returning the entire heat-transfer pipe to normal temperature after the entire heat-transfer pipe is cooled to make the surface pressure between the heat-transfer pipe and the pipe plate lower, a better fit is produced between the outer circumferential surface of the heat-transfer pipe inserted in the pipe hole and the inner circumferential surface of the pipe hole, and the surface pressure between the outer circumferential surface of the heat-transfer pipe inserted in the pipe hole and the inner circumferential surface of the heat-transfer pipe is increased, thus improving the fitting characteristics.

Accordingly, it is possible to increase the retaining force for preventing the heat-transfer pipe from coming out towards the secondary side, and even if a crack occurs in the heat-transfer pipe held in the pipe plate, the primary-side fluid (for example, nuclear-reactor coolant) passing through the interior of the heat-transfer pipe can be prevented from leaking (leaking out) into the secondary-side fluid (for example, feedwater).

In addition, inspection (for example, stress corrosion cracking inspection by rotating ECT (Eddy Current Test)) should be carried out only in a region where the heat-transfer pipe does not come out from the pipe hole even when a prescribed pulling force is applied to the heat-transfer pipe and where the primary-side fluid (for example, nuclear-reactor coolant) passing through the interior of the heat-transfer pipe does not leak (leak out) into the secondary-side fluid (for example, feedwater) even when a crack occurs in the heat-transfer pipe. Therefore, it is possible to significantly reduce the time required for this inspection.

A third aspect of the present invention is a pipe expansion method for securing a heat-transfer pipe inserted in a pipe hole in a pipe plate by expanding the pipe, wherein after tightly fitting an outer circumferential surface of the heat-transfer pipe to an inner circumferential surface of the pipe hole from a primary-side end face to a secondary-side end face of the pipe plate, a predetermined distance range from the secondary-side end face, or close to the secondary-side end face, towards the primary-side end face is further subjected to roller expansion.

According to this aspect, in the roller-expanded region of the pipe, the surface pressure and fitting characteristics between the outer circumferential surface of the heat-transfer pipe inserted in the pipe hole and the inner circumferential surface of the pipe hole are increased. In particular, by subjecting the pipe in the vicinity of the secondary-side end face to roller expansion, which has high surface pressure and superior fitting characteristics, it is possible to produce a satisfactory retaining force and leak prevention with a short pipe expansion region.

Accordingly, it is possible to increase the retaining force for preventing the heat-transfer pipe from coming out towards the secondary side, and even if a crack occurs in the heat-transfer pipe held in the pipe plate, the primary-side fluid (for example, nuclear-reactor coolant) passing through the interior of the heat-transfer pipe can be prevented from leaking (leaking out) into the secondary-side fluid (for example, feedwater).

In addition, inspection (for example, stress corrosion cracking inspection by rotating ECT (Eddy Current Test)) should be carried out only in a region where the heat-transfer pipe does not come out from the pipe hole even when a prescribed pulling force is applied to the heat-transfer pipe and where the primary-side fluid (for example, nuclear-reactor coolant) passing through the interior of the heat-transfer pipe does not leak (leak out) into the secondary-side fluid (for example, feedwater) even when a crack occurs in the heat-transfer pipe. Therefore, it is possible to significantly reduce the time required for this inspection.

A fourth aspect of the present invention is a pipe expansion method for securing a heat-transfer pipe inserted in a pipe hole in a pipe plate by expanding the pipe, including a first step of roller expanding a predetermined distance range from a primary-side end face towards a secondary-side end face of the pipe plate; a second step of hydraulically expanding a predetermined distance range from the secondary-side end face towards the primary-side end face of the pipe plate with a prescribed hydraulic pressure; a third step of roller expanding a region not yet expanded in the first step and the second step; and a fourth step of further hydraulically expanding a predetermined distance range from the secondary-side end face, or close to the secondary-side end face, towards the primary-side end face with a hydraulic pressure higher than the prescribed hydraulic pressure, the steps being performed in sequence.

According to this aspect, the surface pressure between the outer circumferential surface of the heat-transfer pipe inserted in the pipe hole and the inner circumferential surface of the pipe hole is increased in a predetermined distance range from the secondary-side end face of the pipe plate, or close to the end surface, towards the primary-side end face, and the fitting characteristics are thus improved.

Accordingly, it is possible to increase the retaining force for preventing the heat-transfer pipe from coming out towards the secondary side, and even if a crack occurs in the heat-transfer pipe held in the pipe plate, the primary-side fluid (for example, nuclear-reactor coolant) passing through the interior of the heat-transfer pipe can be prevented from leaking (leaking out) into the secondary-side fluid (for example, feedwater).

In addition, inspection (for example, stress corrosion cracking inspection by rotating ECT (Eddy Current Test)) should be carried out only in a region where the heat-transfer pipe does not come out from the pipe hole even when a prescribed pulling force is applied to the heat-transfer pipe and where the primary-side fluid (for example, nuclear-reactor coolant) passing through the interior of the heat-transfer pipe does not leak (leak out) into the secondary-side fluid (for example, feedwater) even when a crack occurs in the heat-transfer pipe. Therefore, it is possible to significantly reduce the time required for this inspection.

A fifth aspect of the present invention is a pipe expansion method for securing a heat-transfer pipe inserted in a pipe hole in a pipe plate by expanding the pipe, wherein after tightly fitting an outer circumferential surface of the heat-transfer pipe to an inner circumferential surface of the pipe hole from a primary-side end face to a secondary-side end face of the pipe plate, a predetermined distance range from the secondary-side end face, or close to the secondary-side end face, towards the primary-side end face is further roller expanded while being cooled.

According to this aspect, by returning the heat-transfer pipe to normal temperature after the heat-transfer pipe is cooled to make the surface pressure between the heat-transfer pipe and the pipe plate lower, a better fit is produced between the outer circumferential surface of the heat-transfer pipe inserted in the pipe hole and the inner circumferential surface of the pipe hole, and the surface pressure between the outer circumferential surface of the heat-transfer pipe inserted in the pipe hole and the inner circumferential surface of the heat-transfer pipe is increased, thus improving the fitting characteristics.

Accordingly, it is possible to increase the retaining force for preventing the heat-transfer pipe from coming out towards the secondary side, and even if a crack occurs in the heat-transfer pipe held in the pipe plate, the primary-side fluid (for example, nuclear-reactor coolant) passing through the interior of the heat-transfer pipe can be prevented from leaking (leaking out) into the secondary-side fluid (for example, feedwater).

In addition, inspection (for example, stress corrosion cracking inspection by rotating ECT (Eddy Current Test)) should be carried out only in a region where the heat-transfer pipe does not come out from the pipe hole even when a prescribed pulling force is applied to the heat-transfer pipe and where the primary-side fluid (for example, nuclear-reactor coolant) passing through the heat-transfer pipe does not leak (leak out) into the secondary-side fluid (for example, feedwater) even when a crack occurs in the heat-transfer pipe. Therefore, it is possible to significantly reduce the time required for this inspection.

In the aspect described above, more preferably, a tapered portion that gradually increases in diameter from a secondary side towards a primary side of the pipe plate is provided.

According to this aspect, because the heat-transfer pipe is expanded outward in the radial direction by the primary-side fluid (for example, nuclear-reactor coolant) passing through the interior of the heat-transfer pipe, the surface pressure between the outer circumferential surface of the heat-transfer pipe inserted in the pipe hole and the inner circumferential surface of the pipe hole can be further increased, and the fitting characteristics can be further improved. Additionally, it is possible to further increase the retaining force for preventing the heat-transfer pipe from coming out towards the secondary side.

A sixth aspect of the present invention is a method of constructing a steam generator provided with a pipe plate and a heat-transfer pipe inserted in a pipe hole in this pipe plate, wherein the heat-transfer pipe is secured in the pipe hole by using any of the pipe expansion methods described above.

According to this aspect, the inspection range (area) of the heat-transfer pipe secured in the pipe plate can be reduced, and the time required for the inspection can be shortened. Therefore, it is possible to shorten the time required for maintenance checks of steam generators, and to improve the utilization rate of steam generators.

The present invention affords an advantage in that it is possible to reduce the inspection range (area) of a heat-transfer pipe secured in a pipe plate, and to shorten the time required for the inspection.

EXPLANATION OF REFERENCE SIGNS

1: nuclear-reactor steam generator
3: pipe plate
3*a*: pipe hole
13: heat-transfer pipe

BEST MODE FOR CARRYING OUT THE INVENTION

A first embodiment of a pipe expansion method according to the present invention will be described below with reference to the drawings.

Figure 1:
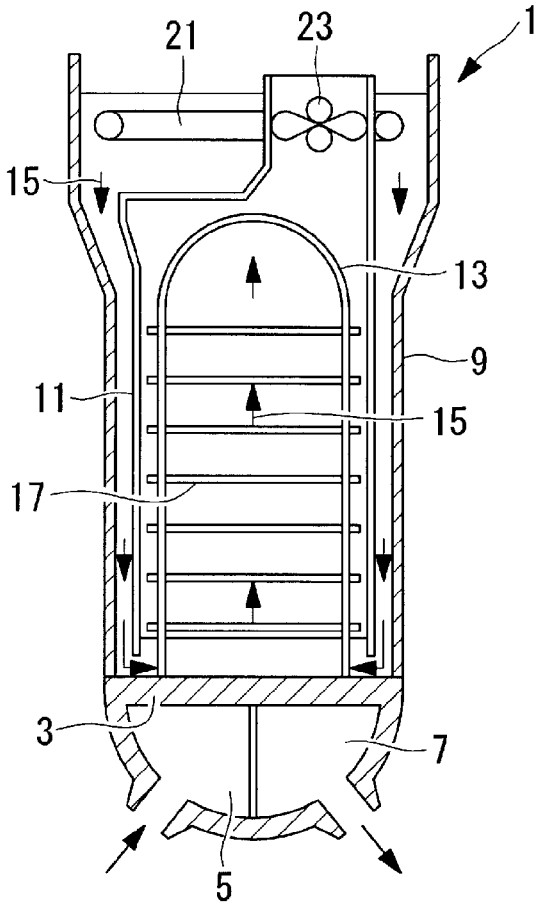
FIG. 1 is a sectional view showing the entirety of a nuclear-reactor steam generator.

FIG. 1 is a sectional view showing the entirety of a nuclear-reactor steam generator 1. A pipe plate 3 is provided at the lower end of this nuclear-reactor steam generator 1, and an inlet water chamber 5 and an outlet water chamber 7 for nuclear-reactor coolant are formed at the bottom of this pipe plate 3. A shell 9 is provided at the upper end of the nuclear-reactor steam generator 1 so as to surround the periphery, and an enveloping pipe 11 and a plurality of inverted-U-shaped heat-transfer pipes (hereinafter, "heat-transfer pipes") 13 are arranged inside this shell 9. These heat-transfer pipes 13 are each formed to be narrow and thin-walled and are configured so that high-temperature nuclear-reactor coolant flows through the interior thereof to heat feedwater 15, which is shell-side fluid, and generate steam.

On the other hand, both ends of each heat-transfer pipe 13 are fitted by insertion into corresponding pipe holes 3*a* in the pipe plate 3 (see FIGS. 2A to 2D). Each heat-transfer pipe 13 is laterally supported by a plurality of support plates 17 disposed with gaps therebetween in the vertical direction.

In the nuclear-reactor steam generator 1 having such a configuration, the high-temperature coolant supplied from the nuclear reactor enters and flows through the heat-transfer pipes 13 via the inlet water chamber 5, is reduced in temperature by shedding heat via heat exchange, flows to the outlet water chamber 7, and then returns to the nuclear reactor.

On the other hand, the feedwater 15 flowing into the nuclear-reactor steam generator 1 from a feedwater ring 21 flows downward between the enveloping pipe 11 and the shell 9, flows on the pipe plate 3, and then flows upward along the heat-transfer pipes 13. During this time, the feedwater 15 undergoes heat exchange with the nuclear-reactor coolant mentioned above, and some of it becomes steam. Then, while the heated feedwater 15 flows upward, it passes through the support plates 17, and the steam, which is separated via a steam separator vane 23, flows out.

The pipe plate 3 is formed of low allow steel, for example, SA508, and the heat-transfer pipes 13 are formed of Inconel 600 or Inconel 690.

Next, the pipe expansion method according to this embodiment will be described using FIGS. 2A to 2D and FIG. 3.

Figure 2A:
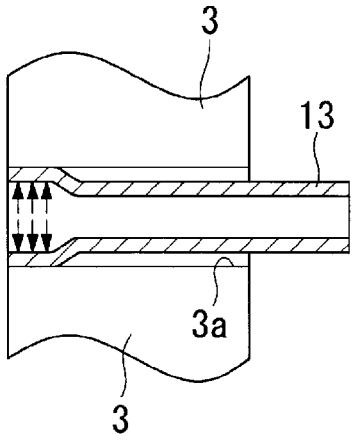
FIG. 2A, is a diagram for explaining a pipe expansion method according to the present invention, illustrating a first step.
Figure 3:
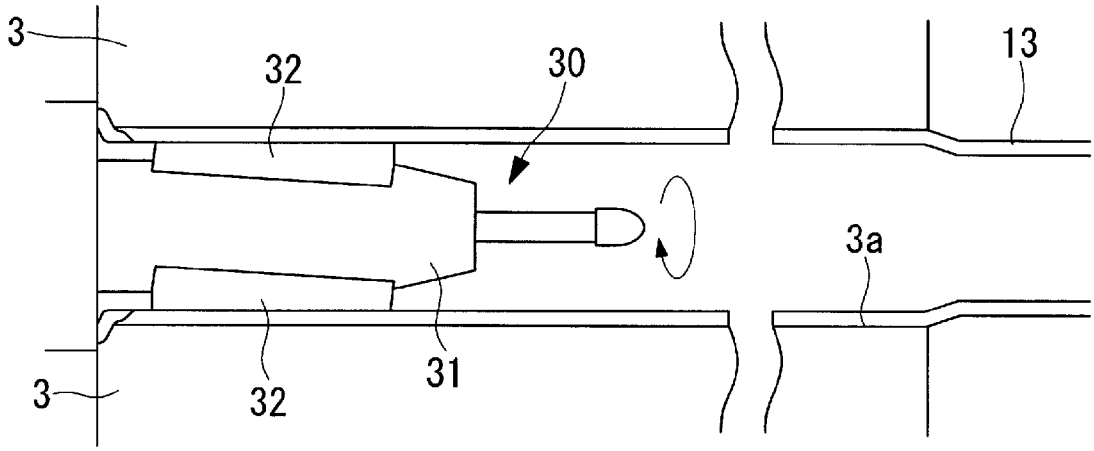
FIG. 3 is a longitudinal sectional view showing a roller-type pipe expanding tool disposed in a portion where the heat-transfer pipe is secured to the pipe plate.

First, in a first step, as shown in FIG. 2A, the ends of the corresponding heat-transfer pipes 13 are each inserted into the respective pipe holes 3*a* passing through the pipe plate 3 in the plate-thickness direction, and a predetermined distance range (the range indicated by the solid arrows in FIG. 2A), from a primary-side end face towards a secondary-side end face of the pipe plate 3, of each end of the heat-transfer pipe 13 inserted in the pipe hole 3*a* is expanded by using a roller-type pipe expanding tool 30 such as that shown in FIG. 3, for instance.

The roller-type pipe expanding tool 30 has a satellite roller 32 mounted so as to be capable of rotating and revolving around a mandrel 31 forming a pointed shaft, and by inserting it into the heat-transfer pipe 13 and applying a rotary torque to the mandrel 31, while applying a thrust thereto, at a pipe expansion position, a pipe-expanding force is transmitted while the satellite roller 32 rotates and revolves, thus widening the pipe.

Figure 2B:
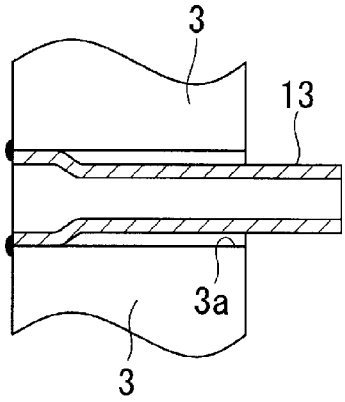
FIG. 2B is a diagram for explaining the pipe expansion method according to the present invention, illustrating a second step.

Then, in a second step, as shown in FIG. 2B, to block a (slight) gap between the outer circumferential surface of the expanded heat-transfer pipe 13 and the inner circumferential surface of the pipe hole 3*a*, seal welding is applied (performed) at the primary-side end face of the pipe plate 3, around the outer circumferential surface of the heat-transfer pipe 13 and the inner circumferential surface of the pipe hole 3*a*.

Figure 2C:
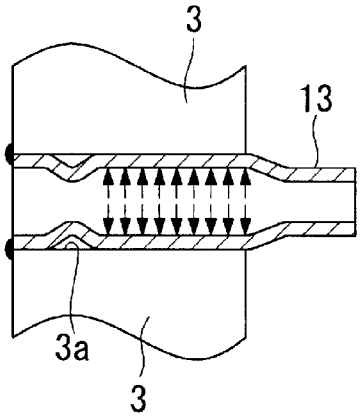
FIG. 2C is a diagram for explaining the pipe expansion method according to the present invention, illustrating a third step.

Next, in a third step, as shown in FIG. 2C, a predetermined distance range (the range indicated by the solid arrows in FIG. 2C), from the secondary-side end face towards the primary-side end face of the pipe plate 3, of each end of the heat-transfer pipe 13 inserted in the pipe hole 3*a* is widened by using a hydraulic pipe-expanding tool (not shown), as disclosed, for example, in Japanese Unexamined Patent Application, Publication No. 2001-269732, previously filed by the present inventors.

Figure 2D:
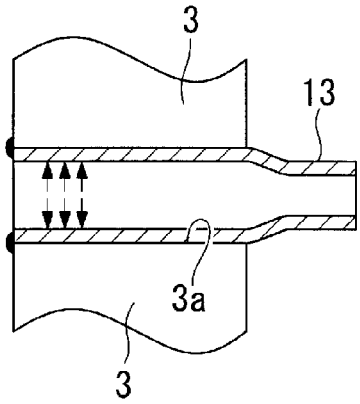
FIG. 2D is a diagram for explaining the pipe expansion method according to the present invention, illustrating a fourth step.

Then, in a fourth step, as shown in FIG. 2D, a range (the range shown by the solid arrows in FIG. 2D), where the pipe has not yet been widened in the first step and the third step, of each end of the heat-transfer pipe 13 inserted in the pipe hole 3*a* is widened by using the roller-type pipe expanding tool 30, such as that shown in FIG. 3, for instance, and the entire outer circumferential surface at each end of the heat-transfer pipe 13 inserted in the pipe hole 3*a* is thus tightly fitted with the inner circumferential surface of the pipe hole 3*a*.

Finally, in a fifth step, while passing refrigerant (for example, liquid nitrogen) supplied from a refrigerant supply (not shown) through the interior of the heat-transfer pipe 13, the entire heat-transfer pipe 13 is cooled. During this time, the heat-transfer pipe 13 contracts in the radial direction and the longitudinal direction, and the surface pressure between the heat-transfer pipe 13 and the pipe plate 3 is reduced. Then, when the entire heat-transfer pipe 13 is sufficiently cooled (when a prescribed time passes in this state), the supply of refrigerant from the refrigerant supply is stopped.

With the pipe expansion method according to this embodiment, by returning the entirety of the heat-transfer pipe 13 to normal temperature after the entirety of the heat-transfer pipe 13 is cooled in the fifth step and the surface pressure between the heat-transfer pipe 13 and the pipe plate 3 is reduced, the fit between the outer circumferential surface of each end of the heat-transfer pipe 13 inserted in the pipe hole 3*a* and the inner circumferential surface of the pipe hole 3*a* is improved, and the surface pressure between the outer circumferential surface of each end of the heat-transfer pipe 13 inserted in the pipe hole 3*a* and the inner circumferential surface of the pipe holes 3*a* is increased, thus improving the fitting characteristics.

Accordingly, it is possible to increase the retaining force for preventing the heat-transfer pipe 13 from coming out towards the secondary side, and it is also possible to prevent the nuclear-reactor coolant passing through the interior of the heat-transfer pipe 13 from leaking (leaking out) into the feedwater 15, even when cracking occurs in the heat-transfer pipe 13 held in the pipe plate 3.

In addition, inspection (for example, stress corrosion cracking inspection by rotating ECT (Eddy Current Test)) should be carried out only in a region where the heat-transfer pipe 13 does not slip out of the pipe hole 3 even when a prescribed extraction force is applied to the heat-transfer pipe 13 and where the nuclear-reactor coolant passing through the interior of the heat-transfer pipe 13 does not leak (leak out) into the feedwater 15 even when a crack occurs in the heat-transfer pipe 13. Therefore, it is possible to significantly reduce the time required for this inspection.

Because the heat capacity of the pipe plate 3 is sufficiently larger than the heat capacity of the heat-transfer pipe 13, during cooling of the heat-transfer pipe 13, uniform cooling down to the temperature of the pipe plate 3 can be prevented.

A second embodiment of the pipe expansion method according to the present invention will be described with reference to FIGS. 2A to 2D, FIG. 3, and FIG. 4.

First, in a first step, as shown in FIG. 2A, the ends of the corresponding heat-transfer pipes 13*a* are each inserted into the respective pipe holes 3*a* passing through the pipe plate 3 in the thickness direction, and a predetermined distance range (the range indicated by the solid arrows in FIG. 2A), from the primary-side end face towards the secondary-side end face of the pipe plate 3, of each end of the heat-transfer pipe 13 inserted in the pipe hole 3*a* is expanded by using a roller-type pipe expanding tool such as that shown in FIG. 3, for example.

The roller-type pipe expanding tool 30 has a satellite roller 32 mounted so as to be capable of rotating and revolving around a mandrel 31 forming a pointed shaft, and by inserting it into the heat-transfer pipe 13 and applying a rotary torque to the mandrel 31, while applying a thrust thereto, at a pipe expansion position, a pipe-expanding force is transmitted while the satellite roller 32 rotates and revolves, thus widening the pipe.

Then, in a second step, as shown in FIG. 2B, to block a (slight) gap between the outer circumferential surface of the expanded heat-transfer pipe 13 and the inner circumferential surface of the pipe hole 3*a*, seal welding is applied (performed) at the primary-side end face of the pipe plate 3, around the outer circumferential surface of the heat-transfer pipe 13 and the inner circumferential surface of the pipe hole 3*a*.

Next, in a third step, as shown in FIG. 2C, a predetermined distance range (the range indicated by the solid arrows in FIG. 2C), from the secondary-side end face towards the primary-side end face of the pipe plate 3, of each end of the heat-transfer pipe 13 inserted in the pipe hole 3*a* is widened by using a hydraulic pipe-expanding tool (not shown), as disclosed, for example, in Japanese Unexamined Patent Application, Publication No. 2001-269732, previously filed by present inventors.

Then, in a fourth step, as shown in FIG. 2D, a range (the range shown by the solid arrows in FIG. 2D), where the pipe has not yet been widened in the first step and the third step, of each end of the heat-transfer pipe 13 inserted in the pipe hole 3*a* is widened by using the roller-type pipe expanding tool 30, such as that shown in FIG. 3, for instance, and the entire outer circumferential surface at each end of the heat-transfer pipe 13 inserted in the pipe hole 3*a* is thus tightly fitted with the inner circumferential surface of the pipe hole 3*a*.

Figure 4:
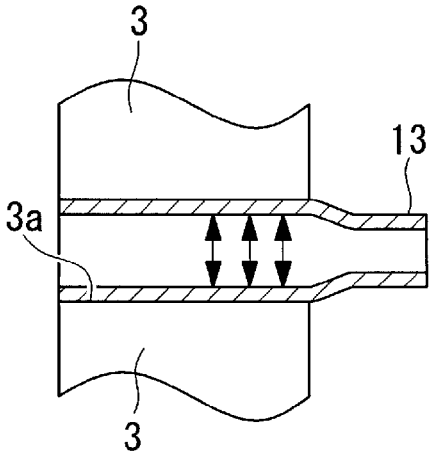
FIG. 4 is a diagram for explaining the pipe expansion method according to the present invention, illustrating a fifth step.

Finally, in a fifth step, as shown in FIG. 4, a predetermined distance range (the range indicated by the solid arrows in FIG. 4), from close to the secondary-side end face towards the primary-side end face of the pipe plate 3, of each end of the heat-transfer pipe 13 inserted in the pipe hole 3*a* is expanded by using a roller-type pipe expanding tool 30 like that shown in FIG. 3, for instance.

With the pipe expansion method according to this embodiment, the surface pressure between the outer circumferential surface of the heat-transfer pipe 13 inserted in the pipe hole 3*a* and the inner circumferential surface of the pipe hole 3*a* is increased in the fifth step over a predetermined distance range from close to the secondary-side end face towards the primary-side end face of the pipe plate 3, thus improving the fitting characteristics.

Accordingly, it is possible to increase the retaining force for preventing the heat-transfer pipe 13 from coming out towards the secondary side, and in addition, it is possible to prevent the nuclear-reactor coolant passing through the interior of the heat-transfer pipe 13 from leaking (leaking out) into the feedwater 15, even when a crack occurs in the heat-transfer pipe 13 held in the pipe plate 3.

Moreover, inspection (for example, stress corrosion cracking inspection by rotating ECT (Eddy Current Test)) should be conducted only in regions where the heat-transfer pipe 13 does not slide out from the pipe hole 3*a* even when a prescribed pulling force is exerted on the heat-transfer pipe 13 and where the nuclear-reactor coolant passing through the interior of the heat-transfer pipe 13 does not leak (leak out) into the feedwater 15 even if a crack occurs in the heat-transfer pipe 13. Therefore, it is possible to substantially reduce the time required for such inspection.

A third embodiment of the pipe expansion method according to the present invention will be described with reference to FIGS. 2A to 2D and FIG. 3.

First, in a first step, as shown in FIG. 2A, the ends of the corresponding heat-transfer pipes 13*a* are each inserted into respective pipe holes 3*a* passing through the pipe plate 3 in the thickness direction, and a predetermined distance range (the range indicated by the solid arrows in FIG. 2A), from the primary-side end face towards the secondary-side end face of the pipe plate 3, of each end of the heat-transfer pipe 13 inserted in the pipe hole 3*a* is expanded by using a roller-type pipe expanding tool 30 such as that shown in FIG. 3, for example.

The roller-type pipe expanding tool 30 has a satellite roller 32 mounted so as to be capable of rotating and revolving around a mandrel 31 forming a pointed shaft, and by inserting it into the heat-transfer pipe 13 and applying a rotary torque to the mandrel 31, while applying a thrust thereto, at a pipe expansion position, a pipe-expanding force is transmitted while the satellite roller 32 rotates and revolves, thus widening the pipe.

Then, in a second step, as shown in FIG. 2B, to block a (slight) gap between the outer circumferential surface of the expanded heat-transfer pipe 13 and the inner circumferential surface of the pipe hole 3*a*, seal welding is applied (performed) at the primary-side end face of the pipe plate 3, around the outer circumferential surface of the heat-transfer pipe 13 and the inner circumferential surface of the pipe hole 3*a*.

Next, in a third step, as shown in FIG. 2C, a predetermined distance range (the range indicated by the solid arrows in FIG. 2C), from the secondary-side end face towards the primary-side end face of the pipe plate 3, of each end of the heat-transfer pipe 13 inserted in the pipe hole 3*a* is widened by using a hydraulic pipe-expanding tool (not shown), as disclosed, for example, in Japanese Unexamined Patent Application, Publication No. 2001-269732, previously filed by present inventors.

Then, in a fourth step, as shown in FIG. 2D, a range (the range shown by the solid arrows in FIG. 2D), where the pipe has not yet been widened in the first step and the third step, of each end of the heat-transfer pipe 13 inserted in the pipe hole 3*a* is widened by using the roller-type pipe expanding tool 30, such as that shown in FIG. 3, for instance, and the entire outer circumferential surface at each end of the heat-transfer pipe 13 inserted in the pipe hole 3*a* is thus tightly fitted with the inner circumferential surface of the pipe hole 3*a*.

Finally, in a fifth step, a range, from the secondary-side end face to the primary-side end face of the pipe plate 3, of each end of the heat-transfer pipe 13 inserted in the pipe hole 3*a* is further expanded by using, for example, a hydraulic pipe expanding tool (not shown in the drawings) disclosed in Japanese Unexamined Patent Application, Publication No. 2001-269732, previously filed by the present applicant, with the hydraulic pressure supplied to this tool being about 1.03 times the hydraulic pressure in the third step.

With the pipe expansion method according to this embodiment, the surface pressure between the outer circumferential surface of the heat-transfer pipe 13 inserted in the pipe hole 3*a* and the inner circumferential surface of the pipe hole 3*a* is increased in the fifth step over a predetermined distance range from the secondary-side end face towards the primary-side end face of the pipe plate 3, thus improving the fitting characteristics.

Accordingly, it is possible to increase the retaining force for preventing the heat-transfer pipe 13 from coming out towards the secondary side, and in addition, it is possible to prevent the nuclear-reactor coolant passing through the interior of the heat-transfer pipe 13 from leaking (leaking out) into the feedwater 15, even when a crack occurs in the heat-transfer pipe 13 held in the pipe plate 3.

Moreover, inspection (for example, stress corrosion cracking inspection by rotating ECT (Eddy Current Test)) should be conducted only in regions where the heat-transfer pipe 13 does not slide out from the pipe hole 3*a* even when a prescribed pulling force is exerted on the heat-transfer pipe 13 and where the nuclear-reactor coolant passing through the interior of the heat-transfer pipe 13 does not leak (leak out) into the feedwater 15 even if a crack occurs in the heat-transfer pipe 13. Therefore, it is possible to substantially reduce the time required for such inspection.

A fourth embodiment of the pipe expansion method according to the present invention will be described with reference to FIGS. 2A to 2D, FIG. 3, and FIG. 5.

First, in a first step, as shown in FIG. 2A, the ends of the corresponding heat-transfer pipes 13*a* are each inserted into respective pipe holes 3*a* passing through the pipe plate 3 in the thickness direction, and a predetermined distance range (the range indicated by the solid arrows in FIG. 2A), from the primary-side end face towards the secondary-side end face of the pipe plate 3, of each end of the heat-transfer pipe 13 inserted in the pipe hole 3*a* is expanded by using a roller-type pipe expanding tool 30 such as that shown in FIG. 3, for example.

The roller-type pipe expanding tool 30 has a satellite roller 32 mounted so as to be capable of rotating and revolving around a mandrel 31 forming a pointed shaft, and by inserting it into the heat-transfer pipe 13 and applying a rotary torque to the mandrel 31, while applying a thrust thereto, at a pipe expansion position, a pipe-expanding force is transmitted while the satellite roller 32 rotates and revolves, thus widening the pipe.

Then, in a second step, as shown in FIG. 2B, to block a (slight) gap between the outer circumferential surface of the expanded heat-transfer pipe 13 and the inner circumferential surface of the pipe hole 3*a*, seal welding is applied (performed) at the primary-side end face of the pipe plate 3, around the outer circumferential surface of the heat-transfer pipe 13 and the inner circumferential surface of the pipe hole 3*a*.

Next, in a third step, as shown in FIG. 2C, a predetermined distance range (the range indicated by the solid arrows in FIG. 2C), from the secondary-side end face towards the primary-side end face of the pipe plate 3, of each end of the heat-transfer pipe 13 inserted in the pipe hole 3*a* is widened by using a hydraulic pipe-expanding tool (not shown), as disclosed, for example, in Japanese Unexamined Patent Application, Publication No. 2001-269732, previously filed by the present inventors.

Then, in a fourth step, as shown in FIG. 2D, a range (the range shown by the solid arrows in FIG. 2D), where the pipe has not yet been widened in the first step and the third step, of each end of the heat-transfer pipe 13 inserted in the pipe hole 3*a* is widened by using the roller-type pipe expanding tool 30, such as that shown in FIG. 3, for instance, and the entire outer circumferential surface at each end of the heat-transfer pipe 13 inserted in the pipe hole 3*a* is thus tightly fitted with the inner circumferential surface of the pipe hole 3*a*.

Figure 5:
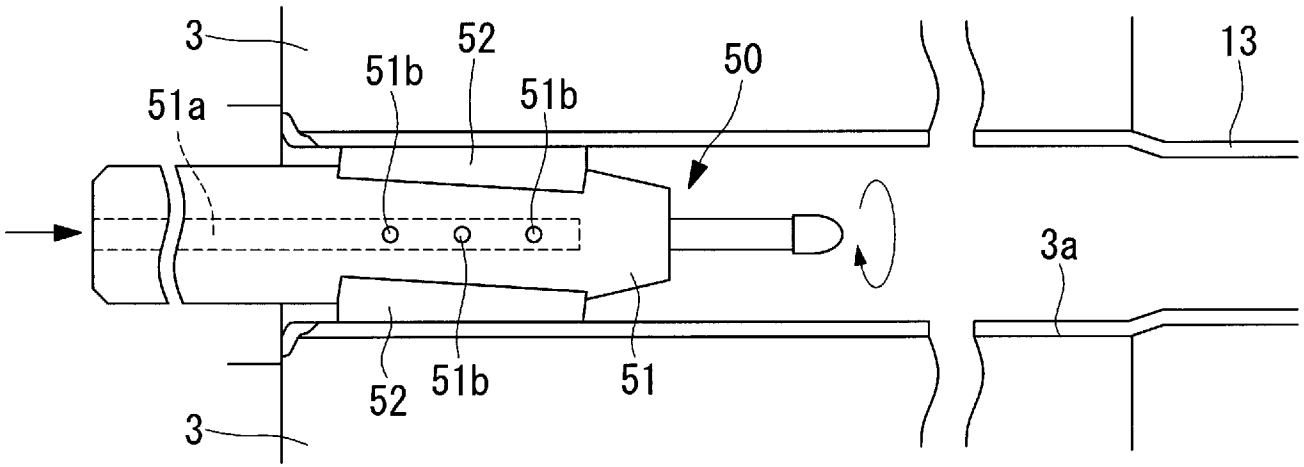
FIG. 5 is a longitudinal sectional view showing another roller-type pipe expanding tool disposed in a portion where the heat-transfer pipe is secured to the pipe plate.

Finally, in a fifth step, a range, from the secondary-side end face to the primary-side end face of the pipe plate 3, of each end of the heat-transfer pipe 13 inserted in the pipe hole 3*a* is expanded using, for example, a roller-type pipe expanding tool 50 such as that shown in FIG. 5.

The roller-type pipe expanding tool 50 has a satellite roller 52 mounted so as to be capable of rotating and revolving around a mandrel 51 forming a pointed shaft, and by inserting it into the heat-transfer pipe 13 and applying a rotary torque to the mandrel 51, while applying a thrust thereto, at a pipe expansion position, a pipe-expanding force is transmitted while the satellite roller 52 rotates and revolves, thus widening the pipe. A central hole 51*a* is formed along the rotation axis at the central portion of the mandrel 51, and at the outer side in the radial direction, a plurality of communicating holes 51*b* that communicate between the central hole 51*a* and the outer circumferential surface of the mandrel 51 are formed in a direction orthogonal to the rotation axis. Refrigerant (for example, liquid nitrogen) from a refrigerant supply, which is not shown in the drawings, is supplied inside the central hole 51*a*, and the refrigerant supplied inside the central hole 51*a* is sprayed against an internal wall of the heat-transfer pipe 13 from the communicating holes 51*b*, thus cooling the heat-transfer pipe 13. During this time, the heat-transfer pipe 13 contracts in the radial direction and the longitudinal direction, and the surface pressure between the heat-transfer pipe 13 and the pipe plate 3 is thus reduced. Then, once the heat-transfer pipe 13 has sufficiently cooled (when a prescribed period of time has elapsed in this state), the supply of refrigerant from the refrigerant supply is stopped.

With the pipe expansion method according to this embodiment, the surface pressure between the outer circumferential surface of the heat-transfer pipe 13 inserted in the pipe hole 3*a* and the inner circumferential surface of the pipe hole 3*a* is increased in the fifth step over a predetermined distance range from close to the secondary-side end face towards the primary-side end face of the pipe plate 3, thus improving the fitting characteristics.

Accordingly, it is possible to increase the retaining force for preventing the heat-transfer pipe 13 from coming out towards the secondary side, and in addition, it is possible to prevent the nuclear-reactor coolant passing through the interior of the heat-transfer pipe 13 from leaking (leaking out) into the feedwater 15, even when a crack occurs in the heat-transfer pipe 13 held in the pipe plate 3.

Moreover, inspection (for example, stress corrosion cracking inspection by rotating ECT (Eddy Current Test)) should be conducted only in regions where the heat-transfer pipe 13 does not slide out from the pipe holes 3*a* even when a prescribed pulling force is exerted on the heat-transfer pipe 13 and where the nuclear-reactor coolant passing through the interior of the heat-transfer pipe 13 does not leak (leak out) into the feedwater 15 even if a crack occurs in the heat-transfer pipe 13. Therefore, it is possible to substantially reduce the time required for such inspection.

Figure 6:
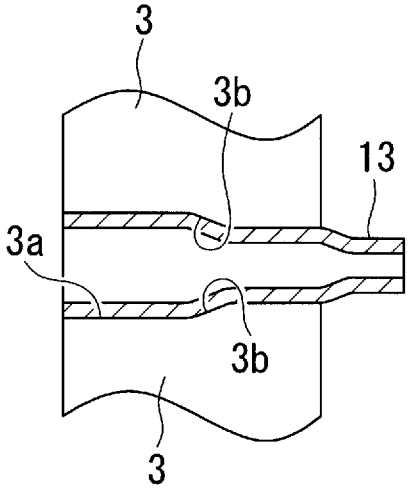
FIG. 6 is a longitudinal sectional view of another pipe hole where it is possible to use the pipe expansion method according to the present invention.

The cross-sectional shape of the pipe hole 3*a* in the embodiments described above is more preferably as shown in FIG. 6. In other words, in the pipe hole 3*a* in the embodiments described above, it is more preferable to provide a tapered portion 3*b* that gradually (progressively) increases in diameter from the secondary side towards the primary side, or in other words, that becomes gradually (progressively) narrower from the primary side towards the secondary side.

By providing the tapered portion 3*b*, because the heat-transfer pipe 13 is expanded outward in the radial direction by the nuclear-reactor coolant passing through the interior of the heat-transfer pipe 13, the surface pressure between the outer circumferential surface of the heat-transfer pipe 13 inserted in the pipe hole 3*a* and the inner circumferential surface of the pipe hole 3*a* can be further increased, and the fitting characteristics can be further improved. Additionally, it is possible to further increase the retaining force for preventing the heat-transfer pipe 13 from coming out towards the secondary side.

The present invention is not limited to the embodiments described above; it is possible to make modifications as required. For example, in the embodiments described above, instead of the roller-type pipe expanding tool 30 such as that shown in FIG. 3, it is also possible to use the roller-type pipe expanding tool 50 such as that shown in FIG. 5.

The invention claimed is:

1. A pipe expansion method for securing a heat-transfer pipe inserted in a pipe hole in a pipe plate by expanding the pipe, comprising:

a first step of roller expanding the heat-transfer pipe a predetermined distance range from a primary-side end face towards a secondary-side end face of the pipe plate;

a second step of hydraulically expanding the heat-transfer pipe a predetermined distance range from the secondary-side end face towards the primary-side end face of the pipe plate with a prescribed hydraulic pressure;

a third step of roller expanding a region in the heat-transfer pipe not yet expanded in the first step and the second step; and a fourth step of further hydraulically expanding the heat-transfer pipe a predetermined distance range from the secondary-side end face, or close to the secondary-side end face, towards the primary-side end face with a hydraulic pressure higher than the prescribed hydraulic pressure, the steps being performed in sequence.

2. A pipe expansion method according to claim 1, wherein the pipe hole includes a tapered portion that gradually increases in diameter from a secondary side towards a primary side of the pipe plate.

3. A production method for a steam generator provided with a pipe plate and a heat-transfer pipe inserted in a pipe hole in this pipe plate, wherein the heat-transfer pipe is secured in the pipe hole by using a pipe expansion method according to claim 1.

* * * * *